United States Patent [19]

Amelio et al.

[11] Patent Number: 4,655,833

[45] Date of Patent: Apr. 7, 1987

[54] ELECTROLESS COPPER PLATING BATH AND IMPROVED STABILITY

[75] Inventors: William J. Amelio, Binghamton; Peter G. Bartolotta, Endicott; Voya Markovich, Endwell; Ralph E. Parsons, Endicott, all of N.Y.

[73] Assignee: International Business Machines Corporation, Armonk, N.Y.

[21] Appl. No.: 785,044

[22] Filed: Oct. 9, 1985

Related U.S. Application Data

[63] Continuation of Ser. No. 611,278, May 17, 1984, abandoned.

[51] Int. Cl.[4] ..... C23C 3/02

[52] U.S. Cl. ..... 106/1.23; 106/1.26; 427/443.1

[58] Field of Search ..... 106/1.23, 1.26; 427/443.1

[56] References Cited

U.S. PATENT DOCUMENTS

| | | | |
|---|---|---|---|
| 3,257,215 | 6/1966 | Schneble et al. | 106/1.26 |
| 3,329,512 | 7/1967 | Shipley et al. | 106/1.26 |
| 3,844,799 | 10/1974 | Underkofler et al. | 106/1.26 |

*Primary Examiner*—Lorenzo B. Hayes

*Attorney, Agent, or Firm*—Pollock, Vande Sande & Priddy

[57] ABSTRACT

An electroless copper plating bath having improved stability which contains a cationic polymer from acrylamide and/or methacrylamide. The plating bath also contains a cupric ion source, a reducing agent for the cupric ion source, and a complexing agent for the cupric ion.

20 Claims, No Drawings

ELECTROLESS COPPER PLATING BATH AND IMPROVED STABILITY

This application is a continuation of application Ser. No. 611,278 filed 5-17-84 now abandoned.

DESCRIPTION

1. Technical Field

The present invention is concerned with a copper electroless plating bath and especially with a copper electroless plating bath having improved stability. The present invention provides for a plating bath which is stable, yet capable of high plating rates and produces a high quality copper surface. The present invention makes it possible to significantly reduce the formation of extraneous copper or nodules.

2. Background Art

The electroless plating of copper onto a substrate is well-known in the prior art. For instance, an electroless or autocatalytic copper plating bath usually contains a cupric ion source, a reducing agent for the cupric ion, a chelating or complexing agent, and a pH adjustor. In addition, if the surface being plated is not already catalytic for the deposition of the desired metal, a suitable catalyst is deposited on the surface prior to contact with the plating bath. Among the more widely employed procedures for catalyzing a substrate is the use of stannous chloride sensitizing solution and a palladium chloride activator to form a layer of metallic palladium particles.

Although the technology relative to electroless copper plating is continually being improved, there still remains room for additional improvement. Certain problems are especially pronounced when preparing articles of very high quality such as those to be employed in printed circuit applications (e.g., printed circuit boards which contain high-density circuitry and large numbers of holes such as through-holes and blind holes).

A major reason for yield loss in electroless copper plating is the formation of what is known as extraneous copper or nodules. The formation of nodules in unwanted areas on a substrate can result in short-circuiting by forming contact between circuit lines on the substrate. In addition, such processes as providing protective coatings, providing solder, and pin insertion are adversely affected by the presence of nodules on the surface.

Although the problem of nodule formation can be avoided by the judicious selection of the bath and the conditions of plating by providing a less-active bath, it would be advantageous and desirable to provide a bath exhibiting improved stability while, at the same time, making it possible to increase the rate of plating.

SUMMARY OF INVENTION

The present invention provides an electroless plating bath of improved stability, thereby significantly reducing, if not entirely eliminating the formation of nodules during plating. In addition, the present invention provides a plating bath which is capable of increased plating rates. An especially advantageous aspect of the present invention is the ability to significantly increase the plating rate while, at the same time, avoiding the formation of extraneous copper or nodules.

In addition, the plating bath of the present invention provides high-quality deposited copper of improved ductility. Moreover, the longevity of the baths of the present invention is relatively long (e.g., a bath can be used for about one week).

The present invention is concerned with an electroless copper plating bath of improved stability which comprises about 1 part per billion to about 1,000 parts per billion of a cationic polymer from acrylamide or methacrylamide or from both. The electroless copper plating bath also contains a cupric ion source in an amount of about 3 to about 15 grams per liter calculated as cupric sulfate; a reducing agent for the cupric ion source in an amount of about 0.7 to about 7 grams per liter; and a complexing agent for the cupric ion in an amount of about 20 to about 50 grams per liter.

BEST AND VARIOUS MODES FOR CARRYING OUT INVENTION

According to the present invention, it has been found that electroless copper plating bath of improved stability and capable of providing for increased plating rates can be achieved by providing about 1 part per billion to about 1,000 parts per billion and preferably about 1 part per billion to about 500 parts per billion of a cationic polymer from acrylamide and/or from methacrylamide.

It is believed that the cationic polymer, in the concentrations employed, helps in the oxidation of $Cu^+$, thereby preventing bulk precipitation of $Cu_2O$ which, in turn, enhances the stability of the bath and helps in reducing nodule formation. Moreover, it is believed, in accordance with the present invention, that the cationic polymer acts as a complexing or chelating agent for the cupric ion. Moreover, it is believed that the presence of the cationic polymer in the plating bath acts as a bridging ligand between the metal ions and the surface to be coated, thereby enhancing the rate of the electrochemical reaction providing increased plating rate.

The preferred cationic polymers employed are available under the trade designation "Reten".

The polymer from acrylamide and/or methacrylamide is a multifunctional cationic material in that it must contain at least two active or available cationic moieties. The polymers are at least water-miscible and are preferably water-soluble or at least soluble in the water compositions employed in the present invention. The preferred cationic moieties are quaternary phosphonium and quaternary ammonium groups. Polymers containing at least two cationic moieties are commercially available and need not be described herein in any great detail. Examples of commercially available multifunctional cationic polymers are Reten 210, Reten 220, and Reten 300, available from Hercules, description of which can be found in "Water-Soluble Polymers", Bulletin VC-482A, Hercules Incorporated, Wilmington, Delaware 19899, disclosure of which is incorporated herein by reference.

Reten 210 is in powder form and is a copolymer of acrylamide and betamethacryloxyethyltrimethylammonium methyl sulfate having a Brookfield viscosity of a 1% solution of 600–1000 cps.

Reten 220 is in powder form and is a copolymer of acrylamide and betamethacryloxyethyltrimethylammonium methyl sulfate having a Brookfield viscosity of a 1% solution of 800–1200 cps.

Reten 300 is a liquid and is a homopolymer of betamethacryloxyethyltrimethylammonium methyl sulfate having a Brookfield viscosity of a 1% solution of 300–700 cps.

The molecular weight of the Reten polymers is usually relatively high and varies from about 50,000 to about 1,000,000 or more. These high molecular weight polymers are solid products and their main chemical backbone structure is polyacrylamide. The cationic Reten (positive charge) is obtained by attaching to the polyacrylamide various tetraalkyl ammonium compounds. These quaternary ammonium groups provide the number of positive charges of the polymer. The preferred copper electroless plating baths to which the cationic polymer from acrylamide and/or methacrylamide is added in accordance with the present invention and their methods of application are disclosed in U.S. Pat. Nos. 3,844,799 and 4,152,467 disclosures of which are incorporated herein by reference.

Such copper electroless plating baths generally are aqueous compositions which include a source of cupric ion, a reducing agent, a complexing agent for the cupric ion, and a pH adjustor. The plating baths also preferably include a cyanide ion source and an anionic surface-active agent. The cupric ion source generally used is a cupric sulfate or a cupric salt of the complexing agent to be employed.

The cupric ion source is generally employed in amounts from about 3 to about 15 grams per liter and preferably about 8 to about 12 grams per liter calculated as cupric sulfate.

The most common reducing agent employed is formaldehyde which in the preferred aspects of the present invention are used in amounts from about 0.7 to about 7 grams per liter and most preferably from about 0.7 to about 2.2 grams per liter.

Examples of other reducing agents include formaldehyde derivatives or precursors such as paraformaldehyde, trioxane, dimethylhydantoin, and glyoxal; borohydrides such as alkali metal alkali borohydrides (sodium and potassium borohydride) and substituted borohydrides such as sodium trimethoxy borohydride; boranes such as amine borane (isopropyl amine borane and morpholine borane).

Examples of some suitable complexing agents include Rochelle Salts, ethylene diamine tetraacetic acid, the sodium (mono-, di-, tri-, and tetra-sodium) salts of ethylene diamine tetraacetic acid, nitrilotriacetic acid and its alkali salts, gluconic acid, gluconates, triethanol amine, glucono(gamma)-lactone, modified ethylene diamine acetates such as N-hydroxy ethyl, ethylene diamine triacetate. In addition, a number of other suitable cupric complexing agents are suggested in U.S. Pat. Nos. 2,996,408; 3,075,856; 3,075,855; and 2,938,805 disclosures of which are incorporated herein by reference.

The amount of complexing agent is dependent upon the amount of cupric ions present in the solution as generally from about 20 to about 50 grams per liter or in a 3–4 fold molar excess.

The plating bath also preferably contains an anionic surface active agent which assists in wetting the surface to be coated. A satisfactory anionic surface active agent is, for instance, an organic phosphate ester available under the trade designation "Gafac RE-610". Generally, the anionic surface active agent is present in amounts from about 0.02 to about 0.3 grams per liter.

In addition, the pH of the bath is usually generally controlled, for instance, by the addition of a basic compound such as sodium hydroxide or potassium hydroxide in the necessary amount to achieve the desired pH. The preferred pH of the electroless plating bath employed in accordance with the present invention is between 11.6 and 11.8.

Also, preferably, the plating bath contains a cyanide ion and most preferably contains about 10 to about 25 milligrams per liter to provide a cyanide ion concentration in the bath within the range of 0.0002 to 0.0004 molar. Examples of some cyanides which can be employed according to the present invention are the alkali metal, alkaline earth metal, and ammonium cyanides. In addition, the plating bath can include other minor additives as known in the art.

The preferred plating baths employed have a specific gravity within the range of 1.060 to 1.080. Moreover. the temperature of the bath is preferably maintained between 70° C. and 80° C. and most preferably between 70° C. and 75° C. For a discussion of the preferred plating temperature coupled with the preferred cyanide ion concentrations, see U.S. Pat. No. 3,844,799.

In addition, it is preferred to maintain the $O_2$ of the bath between 2 ppm and 4 ppm and preferably about 2.5 to about 3.5 ppm, as discussed in U.S. Pat. No. 4,152,467. The $O_2$ content can be controlled by injecting oxygen and an inert gas into the bath.

The overall flow rate of the gases into the bath is generally from about 1 to about 20 standard cubic feet per minute per thousand gallons of bath and preferably from about 5 to about 10 standard cubic feet per minute per thousand gallons of bath.

The preferred plating rates employed in accordance with the present invention are about 0.2 to about 0.3 mils of plated copper thickness per hour.

The following non-limiting example is presented to illustrate the present invention.

EXAMPLE 1

A plating bath containing about 9 grams per liter of cupric sulfate, about 2.0 milliliters per liter of formaldehyde, about 36 grams per liter of ethylene diamine tetraacetic acid, about 9 milligrams per liter of sodium cyanide, about 1.2 parts per billion of Reten 210, and about 0.05 grams per liter of Gafac is preferred. The bath has a pH of about 12. The bath is fed through a plating tank at a temperature of about 73° C. The plating tank contains substrates having a thin layer of copper on the surface thereof. The oxygen content of the bath during plating is about 3 ppm. The rate of plating is about 0.2 mils per hour. The nodule rating of the substrate is 1 (nodule rating refers to nodules per square inch with 1 being the best and 5 being the worst). Similar results are obtained with dielectric substrates catalyzed for plating copper electroless plating.

What is claimed is:

1. An electroless copper plating bath of improved stability which comprises:

A. cupric ion source in an amount of about 3 to about 15 grams per liter calculated as cupric sulfate;

B. a reducing agent for the cupric ion source in an amount of about 0.7 to about 7 grams per liter;

C. a complexing agent for the cupric ion in an amount of about 20 to 50 grams per liter; and D. about 1 part per billion to about 1,000 parts per billion of a cationic polymer from acrylamide or methacrylamide, or both.

2. The electroless copper plating bath of claim 1 which contains about 1 part per billion to about 500 parts per billion of said cationic polymer.

3. The electroless copper plating bath of claim 1 which contains an anionic surface-active agent.

4. The electroless copper plating bath of claim 3 wherein said anionic surface-active agent is present in an amount from about 0.02 to about 0.3 grams per liter.

5. The electroless copper plating bath of claim 1 having a pH of about 11.8 to about 12.5.

6. The electroless copper plating bath of claim 1 which has a pH of about 11.9 to about 12.

7. The electroless copper plating bath of claim 1 which also contains about 10 to about 25 milligrams per liter of a cyanide ion.

8. The electroless copper plating bath of claim 1 wherein the cupric ion source is present in an amount from about 8 to about 12 grams per liter calculated as cupric sulfate.

9. The electroless copper plating bath of claim 1 wherein the cupric ion source is cupric sulfate.

10. The electroless copper plating bath of claim 1 wherein the reducing agent is present in an amount from about 3 to about 4 milliliters per liter.

11. The electroless copper plating bath of claim 1 wherein said reducing agent is formaldehyde.

12. The electroless copper plating bath of claim 1 wherein said complexing agent is ethylene diamine tetraacetic acid or salt thereof.

13. The electroless copper plating bath of claim 1 wherein said cationic polymer is a multifunctional cationic polymer.

14. The electroless copper plating bath of claim 1 wherein said cationic polymer is a copolymer of acrylamide and ammonium quaternary compound.

15. A method for coating a substrate which comprises contacting the substrate with an electroless copper plating bath of claim 1.

16. The method of claim 15 wherein said electroless copper plating bath is maintained at a temperature of about 70° C. to about 80° C.

17. The method of claim 15 wherein the temperature of the plating bath is maintained between about 70° C. and 75° C.

18. The electroless copper plating bath of claim 1 which consists essentially of a. cupric ion source in an amount of about 3 to about 15 grams per liter calculated as cupric sulfate;
b. a reducing agent for the cupric ion source in an amount of about 0.7 to about 7 grams per liter;
c. ethylene diamine tetraacetic acid or salt thereof in an amount of about 20 to 50 grams per liter;
d. about 1 part per billion to about 1,000 parts per billion of a cationic polymer from acrylamide or methacrylamide, or both.
e. anionic surface-active agent in an amount of from about 0.02 to about 0.3 grams per liter; and
f. about 10 to about 25 miligrams per liter of a cyanide ion, and wherein the pH of said bath is about 11.8 to about 12.5.

19. The electroless copper plating bath of claim 18 which contains about 1 part per billion to about 500 parts per billion of said cationic polymer; wherein the cupric ion source is present in an amount from about 8 to about 12 grams per liter calculated as cupric sulfate; and wherein the reducing agent is present in an amount from about 3 to about 4 milliliters per liter.

20. The electroless copper plating bath of claim 18 wherein said cationic polymer is a copolymer of acrylamide and ammonium quaternary compound, and said anionic surface-active agent is an organic phosphate ester.

* * * * *